US005225624A

United States Patent [19]

Schneider et al.

[11] Patent Number: 5,225,624

[45] Date of Patent: Jul. 6, 1993

[54] DISINTEGRATING INJECTOR FOR PRIMARY AND FUEL ENRICHED PLASMA

[75] Inventors: Mark E. Schneider, Minneapolis; Steven R. Stricker, Brooklyn Center; Michael R. Triviski, North Oakdale; Chris S. Sorenson, Edina, all of Minn.

[73] Assignee: FMC Corporation, Chicago, Ill.

[21] Appl. No.: 807,482

[22] Filed: Dec. 16, 1991

[51] Int. Cl.[5] ..... F41B 6/00

[52] U.S. Cl. ..... 89/8; 102/202.7; 102/472

[58] Field of Search ..... 42/84; 89/8, 28.05, 89/135; 102/202.5, 202.6, 202.7, 202.8, 202.9, 472

[56] References Cited

U.S. PATENT DOCUMENTS

| | | | |
|---|---|---|---|
| 4,895,062 | 1/1990 | Chryssomallis et al. | 89/8 |
| 4,957,035 | 9/1990 | Eskam et al. | 89/8 |
| 4,974,487 | 12/1990 | Goldstein et al. | 89/8 |
| 5,072,647 | 12/1991 | Goldstein et al. | 89/8 |

FOREIGN PATENT DOCUMENTS

| | | | |
|---|---|---|---|
| 382000 | 8/1990 | European Pat. Off. | 89/8 |

OTHER PUBLICATIONS

Metzgdr, Terry L., "Electrothermal Guns:" National Defense, Sep. 1990, pp. 20–23.

*Primary Examiner*—Stephen C. Bentley

*Attorney, Agent, or Firm*—G. Wolde-Michael; R. C. Kamp; R. B. Megley

[57] ABSTRACT

The apparatus and method disclosed herein relates to the generation of primary and fuel-enriched plasma to provide ignition and delivery for large amounts of electrical and electrothermal power to a propellant mass. Particularly, the present invention enables the creation of zones of controlled combustion by initially incubating primary plasma in a capillary chamber and mixing the primary plasma with fuel in a fuel chamber thus creating a fuel-enriched plasma. The primary plasma and the fuel-enriched plasma are segregatively, collectively and substantially simultaneously injected into the propellant mass via outlet ports and nozzles. The capillary and fuel chambers, and the nozzles and outlet ports undergo staged disintegration at reaching predetermined pressures and temperatures and are thereby consumed in the combustion process.

8 Claims, 1 Drawing Sheet

DISINTEGRATING INJECTOR FOR PRIMARY AND FUEL ENRICHED PLASMA

FIELD OF THE INVENTION

The present invention relates to an apparatus and method for developing primary plasma and more particularly fuel-enriching a portion of the primary plasma and segregatively and collectively injecting both the primary and fuel-enriched plasma into a combustible mass using disintegrating plasma injection capillaries and nozzles.

SUMMARY OF THE INVENTION

It is an object of the present invention to provide an apparatus and method for incubating a plasma arc in a capillary chamber, until a predetermined level of energy and a stable discharge arc is maintained to sustain the flow of primary plasma between two electrodes, to provide an ignition source and a delivery means for large amounts of electrical power to a surrounding combustible mass.

Another object of the present invention is to provide an apparatus and method for forming primary plasma to invade a combustible mass while at the same time fuel-enriching the primary plasma to further invade the combustible mass thus creating zones of controlled plasma distribution which in turn control the rate of combustion of the combustible mass.

Yet another object of the present invention is the creation of a stable primary plasma arc after which a portion of the primary plasma is mixed with a surrounding propellant to create a fuel-charged plasma element to invade a combustible mass target. The primary plasma and the fuel-charged plasma are separately and in mixed combination injected into the combustible mass via an assembly of outlet orifice means and ports or nozzles attached to capillaries which assembly undergoes a staged disintegration at reaching predetermined pressures and temperatures.

To achieve the above objects, there is provided consonant with the present invention, a stageably disintegrating injector for primary and fuel-enriched plasma which includes an outer tubular housing having a bottom end and a top end with a forward propellant chamber disposed at the top end. Means for forming a capillary chamber having a bore therethrough and having a first and a second end wherein a plasma incubation region is formed is also provided. The outer tubular housing further contains an aft propellant chamber which surrounds the capillary chamber. An anode and a cathode terminal are disposed at the first and the second ends of the capillary chamber respectively. A fuse wire connects the anode and the cathode terminals. An insulation means separates the anode terminal from a base assembly at the bottom end. Further, a dielectric means is used for lining the internal walls of the outer tubular housing. Furthermore, outlet orifice means and ports, for the flow of primary and fuel-enriched plasma, are set in communication with the forward propellant chamber, the aft propellant chamber and the capillary chamber.

In another aspect of the invention, a stageably disintegrating injector for primary and fuel-enriched plasma having an aft chamber and a forward chamber and a cover means at a bottom end is provided. Additionally, an outer tubular housing having the cover means at the bottom end and enclosing the aft chamber therein and further having a top end with a segment in communication with and providing support for the forward chamber is also provided. A capillary chamber, coaxial with and centrally disposed in said outer tubular housing, having a bore therethrough with a first and a second end wherein an anode terminal is disposed at said first end and a cathode terminal is disposed at said second end is set in place. A fuse wire connects the anode terminal with the cathode terminal. A dielectric liner means coaxially surrounds the capillary chamber. A plasma discharge means is disposed at the top end of the outer tubular housing and communicates with the capillary chamber, the aft chamber and the forward chamber. A shock absorber comprising cushion means is disposed between the anode terminal and the base cover means. Further, a dielectric sleeve means forming a lining between the outer tubular housing, the shock absorbing means and the anode terminal provides insulation and resilience for shock absorption.

Moreover, the present invention discloses a method of injecting primary and fuel-enriched plasma into a combustible mass utilizing an aft and a forward propellant chambers including the steps of incubating primary plasma in a capillary chamber. The primary plasma is injected into a forward propellant chamber via outlet orifice means and ports. The capillary chamber is further ruptured upon the primary plasma reaching predetermined pressures and temperature to mix it with propellant in an aft propellant chamber, adjacent to the capillary chamber, thus forming a fuel-enriched plasma. Furthermore, the primary plasma as well as the fuel-enriched plasma are injected into the forward propellant chamber via the outlet orifice means and ports thus igniting the propellant and creating controllable zones of plasma distribution to augment combustin.

DESCRIPTION OF THE PREFERRED EMBODIMENTS

The stageably disintegrating injector for primary and fuel-enriched plasma disclosed herein combines the advantages of plasma initiated ignition with a plasma delivery system that is capable of creating a spatially expanded plasma front resulting in several controllable zones of combustion thus subjecting, substantially simultaneously, a large portion of a propellant mass to high temperature plasma. Particularly, by incubating primary plasma until a predetermined pressure and temperature is reached and mixing a portion of the primary plasma with fuel to fuel-enrich it, an effective spatially distributed plasma front is generated which can deliver large amounts of electrical and electrothermal energy to a propellant mass.

It is one of the objectives of the disclosed invention to enhance the ignition and augment the combustion of a propellant mass by subjecting it to primary, fuel-enriched and a combination of primary-fuel-enriched high temperature plasma. U.S. Pat. No. 4,895,062, Chryssomallis et al discloses, inter alia, a typical ammunition for use in a Combustion Augmented Plasma (CAP TM) gun wherein a high energy pulse forming network (PFN), plasma injector and capillary are set in a gun breech block and remain in the gun as successive cartridge rounds are fired. The Chryssomallis, et al patent supra, further discloses a device for plasma generation and transfer which is based on creating plasma in a capillary and injecting the plasma into a propellant mass. The present invention is distinguished from the prior art in that, under normal applications, the device is integrally coupled to a cartridge and is both consumable and disposable when the round is fired. Moreover, the present invention utilizes a capillary to generate and incubate primary plasma such that the capillary is ruptured at predetermined pressure and temperature to infuse a portion of the primary plasma with fuel so that a two-phase plasma, i.e. primary and fuel-enriched plasma, front having a larger spatial distribution is created. Thus, while the generation of plasma to invade a combustible or propellant mass is within the scope of the prior art, the present invention achieves and provides several distinctive advantages over the prior art by incubatively developing a primary plasma in a capillary chamber to be used as an ignition source as well as to create fuel-enriched plasma. Accordingly, some of the most important distinguishing features and advantages of this invention are discussed hereinbelow.

Figure 1:
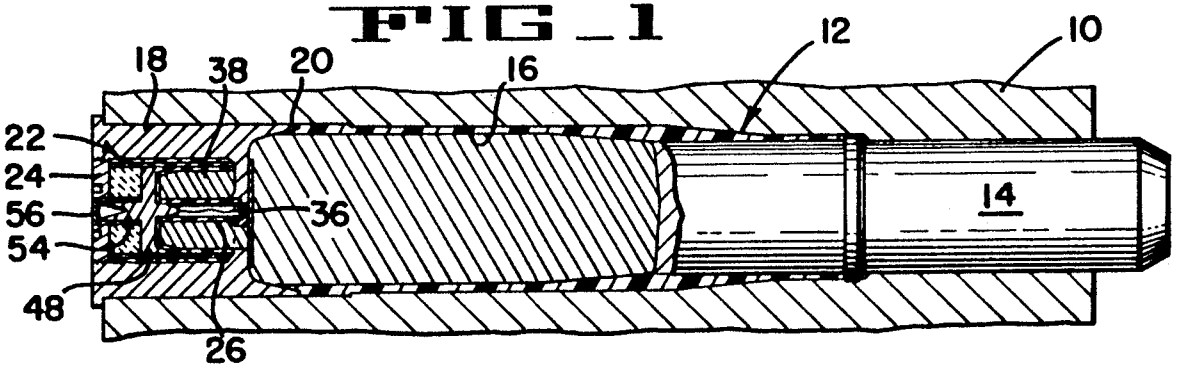
FIG. 1 is a central section of a gun cartridge assembly with the present invention incorporated therein.
Figure 3:
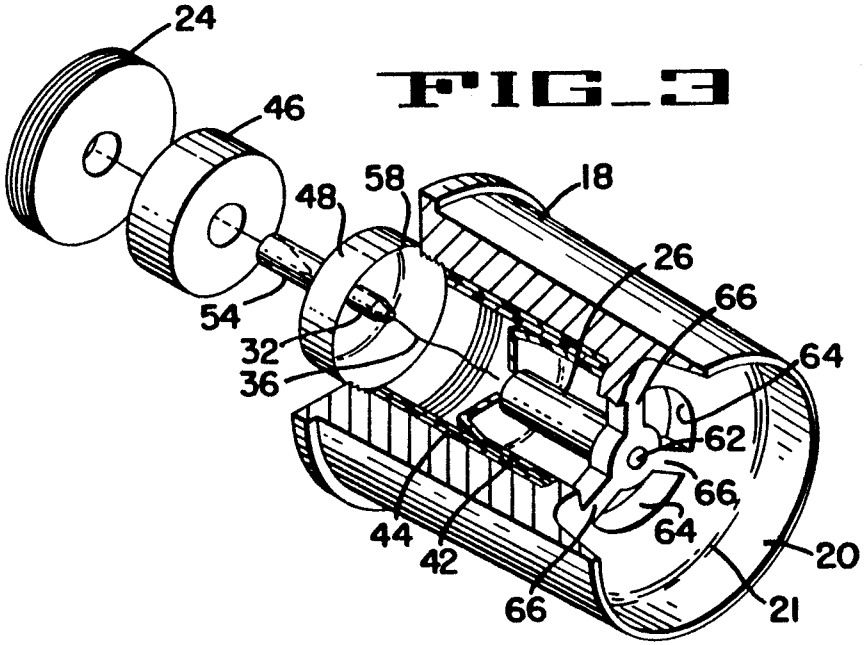
FIG. 3 is an exploded isometric of the present invention with parts broken away.
Figure 2:
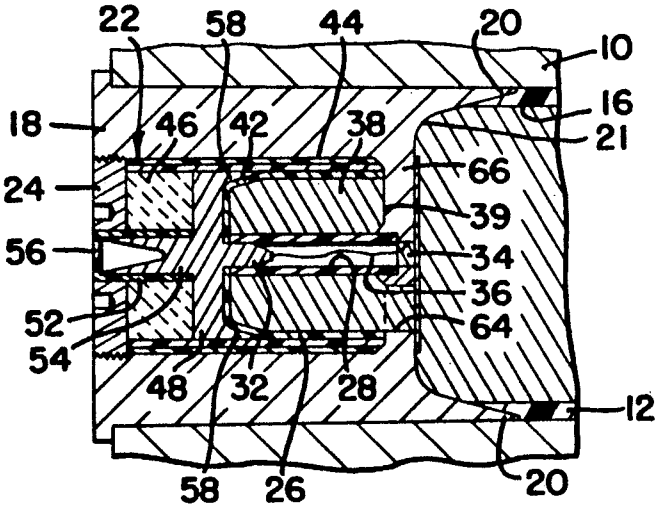
FIG. 2 is an enlarged section of the present invention.

The embodiments of the stageably disintegrating injector for primary and fuel-enriched plasma are shown in FIGS. 1, 2 and 3. FIG. 1 shows the present invention integrated with a cartridge. A gun barrel 10 is shown in which a cartridge 12 is disposed depicting a round ready to fire. The cartridge 12 is integrally coupled to a projectile 14. The cartridge 12 contains a propellant or combustible mass in a forward propellant chamber 16. The cartridge 12 is also integrally coupled to an outer tubular housing 18 which has a top end segment in communication with and forms both a support and a seat cavity for the cartridge 12 with the forward propellant chamber 16 set therein. Further, encapsulated in the outer tubular housing 18 is the disintegrating injector 22 for primary and fuel-enriched plasma.

Referring now to FIG. 2, a detailed embodiment of the disintegrating injector 22 for primary and fuel-enriched plasma is shown. The outer tubular housing 18 has a top end 20 and an opposite bottom end with a base assembly or cover 24 integrally coupled to it. As mentioned hereinabove, the top end 20 of the outer tubular housing 18 comprises a top end cavity 21 in communication with and providing support and an integral coupling for the forward propellant chamber 16. A capillary chamber 26 coaxial with the outer tubular housing 18 is disposed therein. The capillary chamber 26 includes a bore 28 having a first end in which an anode terminal 32 is engaged and a second end at which a cathode terminal 34 is affixed. A fuse wire 36 connects the anode terminal 32 to the cathode terminal 34. An aft propellant chamber 38 having a dielectric liner 42 coaxially surrounds the capillary chamber 26. A plurality of dielectric sleeves 44 set between the outer tubular housing 18 and the dielectric liner 42 provide insulation and structural support. A plurality of cushions 46 comprising ceramic washers are interposed between an anode terminal plate 48 and the base assembly 24. Further, an insulation sleeve 52 isolates the base assembly 24 from a conical cavity 54 of the anode terminal plate 48 where a power supply contact 56 is secured. The anode terminal plate 48 comprises flange extensions 58 which provide structural support to the aft propellant chamber 38 and the dielectric liner 42.

Turning now to FIG. 3 an exploded isometric of the stageably disintegrating plasma injector 22 for primary and fuel-enriched plasma with parts broken away is shown. Particularly, a detail of the outer tubular housing 18 top end cavity 21 shows primary plasma discharge outlet orifice or nozzle 62 in apposition to the bore 28 of the capillary chamber 26. Further, a plurality of outlet orifice means and ports or discharge nozzles 64 which serve to discharge fuel-enriched plasma into the top end cavity 21, form equi-sectoral openings, bounded by spokes or rails radiating from a centrally located hub-like opening. The hub-like opening forms the primary plasma outlet orifice means 62. The spokes or rails 66 which partition the ports 64 are also used to support the cathode terminal 34 at the second end of the capillary chamber 26.

The disclosed invention may be used in electrothermal cannon ammunition systems and Combustion Augmented Plasma (CAP TM) gun systems. The device may be used in both small, intermediate and large caliber gun systems. For example, in the best known and tested mode for a 105 mm gun cartridge, the disclosed device was contained in a dimension envelope of about 6½ inches long by about 5¼ inches in diameter. The primary plasma discharge nozzle 62 has an opening area about ⅛ of the aggregate area of the fuel-enriched plasma discharge nozzles 64. A fuse wire 36 made of a conductive material was used to transfer the electrical input as well as incubatively form primary plasma in the capillary chamber 26. The firing test was conducted using a total propellant mass of about 4000 cc in both the forward propellant chamber 16 and the aft propellant chamber 38. Test results have shown that for an input of about 1200 Kilo Joules of energy, the system reached an efficiency level of 72% and a projectile speed of over 860 meters per second was recorded. It should be noted that variations in the dimension envelope, projectile mass as well as the distance between the anode terminal 32 and the cathode terminal 34 may be made to provide higher efficiency and output levels. Particularly, the components of the disclosed invention provide design flexibility and can be tailored for use in intermediate sized cannons as well as large cannons. For example, it is possible to standardize a unit size of disintegrating injectors 22 for primary and fuel-enriched plasma and vary the numbers to be used based on the size of the cannon. Accordingly, the disclosed invention can be adapted for firing cartridges in guns of various calibers and sizes to optimize both the energy output and the muzzle velocity of the projectile.

A firing sequence or an operational sequence utilizing the disclosed invention of FIGS. 1, 2 and 3, begins with a pulse forming network (PFN) power supply input through the power supply contact 56 being introduced at the conical cavity 54 of the anode terminal plate 48. The electrical energy is thus directed to the cathode terminal 34 via the fuse wire 36. Since the cathode terminal 34 is connected to the rails 66 this arrangement enables the use of the outer tubular housing 18 as a power return medium. Thus, electrical discharge flows through the fuse wire 36. Eventually, the fuse wire 36 disintegrates forming a primary plasma arc which is allowed to flow between the anode terminal 32 and the cathode terminal 34. As stated hereinbefore, a stable plasma arc is needed to enable the transfer and dissipation of large amounts of electrical energy into the propellant mass.

In the present disclosure, two factors work together to stabilize the plasma arc. First, by locating the primary plasma discharge arc, which is the same as and coincides with the fuse wire 36 stretch, axially along the center line of the capillary chamber 26 which in turn is coaxial with the outer tubular housing 18, the plasma arc is symmetrically located. Second, the capillary chamber 26 isolates the plasma within the bore 28 thus protecting the stability and consistency of the plasma arc after the fuse wire 36 disintegrates. Particularly, the present invention enables the incubation of a primary plasma arc by sheltering it within the capillary housing 26 until a predetermined energy level is reached at which time the capillary chamber 26 disintegrates. Immediately after the formation of a discharge arc, which subsequently evolves into a mature primary plasma, the plasma discharge is used to initially ignite a propellant mass contained in the forward propellant chamber 16. At this point, only the primary plasma discharge nozzle 62 injects plasma into the forward propellant chamber 16. The duration of isolation of the primary plasma in the capillary chamber 26 can be varied by selecting capillary wall material that is designed to fail at specified pressures and or temperature. However, once the capillary chamber 26 ruptures, under the influence of the primary plasma, the capillary chamber 26 dielectric wall material will be ablated and consumed to further fuel the primary plasma.

One of the significant aspects of the disclosed invention is, therefore, the creation of a spatially expanded plasma front by mixing primary plasma with fuel from the surrounding fuel chamber 38 to form a fuel-enriched plasma. Upon rupture of the capillary chamber 26, a portion of the hot primary plasma flows radially into the surrounding aft propellant chamber 38 igniting and sustaining combustion in this chamber. The resultant effect of the rupture of the capillary chamber 26 and the attendant combustion of the aft propellant in the adjacent aft propellant chamber 38 is to force combustion products forward into the forward propellant chamber 16. Specifically, the primary plasma mixes with the propellant in the aft propellant chamber 38 to form a fuel-enriched plasma which explodes and ruptures the membrane barrier 39 thus injecting the fuel-enriched plasma into the forward propellant chamber 16 via the discharge nozzles 64. Accordingly, the disclosed invention enables the injection of primary and fuel-enriched plasma into the propellant chamber 16.

The stageably disintegrating injector 22 for primary and fuel-enriched plasma is designed so that the capillary chamber 26, the membrane barrier 39, the primary discharge nozzle 62, the fuel-enriched plasma nozzles 64 and the rails 66 undergo a staged disintegration. As discussed herein above, at a controlled point in time the pressure in the capillary chamber 26 reaches a predetermined level which causes the rupture of the capillary chamber 26 walls. Similarly, combustion forces in the aft propellant chamber 38 push forward until the membrane barrier 39 is ruptured and fuel-enriched plasma begins to flow through the discharge nozzles 64, into the forward propellant chamber 16. The primary plasma also flows through the primary plasma nozzle 62. The nozzles 62 and 64 as well as the rails 66 disintegrate after combustion is well-established in the forward propellant chamber 16. Eventually, both the capillary chamber 26 and the dielectric liner 42 are ablated and provide combustive fuel for the system. The power supply contact 56 continues to supply energy which sustains an arc between the anode terminal 32 and the cathode terminal 34 through the combusting propellant. The power supplied to the plasma controls the plasma flow as well as the rate of incursion of the combusting propellant in the aft chamber 38 into the propellant in the forward chamber 16 which in turn influences the rate of combustion and ultimately the muzzle velocity of the projectile 14.

One of the many advantages of the present invention is that not only is the device compact and many of the component parts stageably disintegrate and ablatively provide combustive fuel for the primary and fuel-enriched plasma, but also most of the parts are decidedly designed to perform several functions. This aspect of the invention makes the disclosed invention space-volume optimal so that the piece parts take up limited space leaving most of the volume for fuel or propellant containment. For example, the anode terminal plate 48 serves as a support base for the aft propellant chamber 38 as well as provides lateral support at the flange 58. Similarly, the cushions 46 comprising ceramic layers are used to isolate the anode plate 48 from the bottom cover plate 24, to avoid short circuiting the power input, as well as provide recoil shock absorption from the explosion shock which is created due to reaction forces and pressures formed in the capillary chamber 26 when it ruptures. Further, the cushions 46 absorb recoil shock resulting from the explosive combustion initiated by the primary plasma in both the aft propellant chamber 38 and the forward propellant chamber 16. Consequently, the cushions 46 absorb the explosion shock loads and retain the integrity of the base assembly 24 and the outer tubular housing 18. Similarly, the dielectric sleeves 44 provide axial resilience and flexing when the assembly is subjected to compressive shock loads and thus cooperates with the cushions 46 to absorb shock loads. The dielectric sleeves 44 also insulate and isolate the tubular outer housing 18 from the other parts of the disintegrating injector 22 for primary and fuel-enriched plasma. As mentioned hereinbefore, the rails 66 also provide dual functions of providing support to the cathode terminal 34 and partitioning the fuel-enriched plasma nozzles 64.

The present invention therefore provides several advantages by using a simplified design that is adaptable to a variety of cartridge and gun systems. It allows the creation of a stable plasma arc which is conducive to high energy input. Furthermore, the components used in the present invention are consumable to provide fuel for the combustion created in both the capillary and propellant chambers. These disintegrating components and their compact configurative design allow the development of a spatially distributed plasma front and enable the use of high energy electrical inputs resulting in high temperature plasma. Accordingly, some of the most critical parameters of the disclosed invention include, designing the appropriate capillary wall strength for the capillary chamber 26, sizing the primary plasma discharge nozzle 62, optimizing the distance between the anode terminal 32 and the cathode terminal 34, designing and sizing the aft propellant chamber 38 wall strength and capacity, sizing the discharge nozzles 64 for fuel-enriched plasma, and sizing a shock absorber such as the cushions 46 comprising the ceramic layers. Consistent with these parameters, the device of the present invention can be built for an effective incubation of a primary plasma, optimal mixing of the primary plasma with a surrounding propellant to form a fuel-enriched plasma, injection of the primary plasma and the fuel-enriched plasma segregatively and substantially collectively into a combustible mass, and the staged disintegration of the components in order to provide high muzzle velocity with low controllable combustion chamber pressures.

Although the best mode contemplated for carrying out the present invention has been herein shown and described, it will be apparent that modification, variations, additions or omission may be made without departing from what is regarded to be the substance, scope and essence of the invention.

What is claimed is:

1. A stageably disintegrating injector for primary and fuel-enriched plasma comprising:

an outer tubular housing having a bottom end and a top end;

said outer tubular housing further having a forward propellant chamber at said top end;

means for forming a capillary chamber having a bore therethrough and a first and a second end wherein a plasma incubation region is formed therein;

said outer tubular housing further having an aft propellant chamber surrounding said capillary chamber;

an anode terminal disposed at said first end of said capillary chamber;

a cathode terminal disposed at said second end of said capillary chamber;

a fuse wire connecting said anode terminal and said cathode terminal and disposed in said bore;

insulation means separating said anode terminal from a base assembly at said bottom end;

dielectric means lining the internal walls of said outer tubular housing; and outlet orifice means and at least one port for the flow of primary and fuel-enriched plasma in communication with said forward propellant chamber and said capillary chamber including said outlet orifice means disposed in apposition to said capillary chamber and said port disposed proximate to said capillary chamber and in apposition to said aft propellant chamber.

2. The stageably disintegrating injector for primary and fuel-enriched plasma of claim 1 wherein said outlet means comprises a primary plasma outlet means centrally located and in axial communication with said capillary chamber.

3. The stageably disintegrating injector for primary and fuel-enriched plasma of claim 1 wherein said port provides outlet means for fuel-enriched plasma and includes at least one port radially disposed around said capillary chamber and in apposition to said aft propellant chamber.

4. A stageably disintegrating injector for primary and fuel-enriched plasma comprising:

an outer tubular housing having a bottom end and a top end;

said outer tubular housing further having a forward propellant chamber at said top end;

means for forming a capillary chamber having a bore therethrough and a first and a second end wherein a plasma incubation region is formed therein;

said outer tubular housing further having an aft propellant chamber surrounding said capillary chamber;

an anode terminal disposed at said first end of said capillary chamber;

a cathode terminal disposed at said second end of said capillary chamber;

a fuse wire connecting said anode terminal and said cathode terminal and disposed in said bore;

insulation means separating said anode terminal from a base assembly at said bottom end;

dielectric means lining the internal walls of said outer tubular housing; and a hub and spokes type arrangement disposed at said top end to thereby form outlet orifice and ports.

5. The stageably disintegrating injector for primary and fuel-enriched plasma of claim 4 wherein said hub is in communication with said capillary and forms an outlet orifice for primary plasma.

6. The stageably disintegrating injector for primary and fuel-enriched plasma of claim 4 wherein said spokes define a radially disposed ports in communication with said aft propellant chamber and provide an outlet means for fuel-enriched plasma.

7. A stageably disintegrating injector for primary and fuel-enriched plasma comprising:

an outer tubular housing having a bottom end and a top end;

said outer tubular housing further having a forward propellant chamber at said top end;

means for forming a capillary chamber having a bore therethrough and a first and a second end wherein a plasma incubation region is formed therein;

said outer tubular housing further having an aft propellant chamber surrounding said capillary chamber;

an anode terminal disposed at said first end of said capillary chamber;

a cathode terminal disposed at said second end of said capillary chamber;

a fuse wire connecting said anode terminal and said cathode terminal and disposed in said bore;

insulation means separating said anode terminal from base assembly at said bottom end;

dielectric means lining the internal walls of said outer tubular housing; and a hub and spoke type arrangement disposed at said top end to thereby form outlet orifice and ports and further form a support structure to said cathode terminal.

8. The stageably disintegrating injector for primary and fuel-enriched plasma of claim 7 wherein said spokes form radiating rails connecting said hub to said outer tubular housing and provide support to said cathode terminal.

* * * * *